US011559103B2

(12) United States Patent
McMahon Tumpson et al.

(10) Patent No.: US 11,559,103 B2
(45) Date of Patent: Jan. 24, 2023

(54) SHOE-LIFTING DEVICE

(71) Applicant: BootBud LLC, Wilmington, DE (US)

(72) Inventors: Christine McMahon Tumpson, Pittsburgh, PA (US); Natalie Riley, El Cerrito, CA (US)

(73) Assignee: BootBud LLC, Wilmington, DE (US)

( * ) Notice: Subject to any disclaimer, the term of this patent is extended or adjusted under 35 U.S.C. 154(b) by 833 days.

(21) Appl. No.: 15/656,302

(22) Filed: Jul. 21, 2017

(65) Prior Publication Data

US 2018/0125153 A1 May 10, 2018

Related U.S. Application Data

(60) Provisional application No. 62/365,015, filed on Jul. 21, 2016.

(51) Int. Cl.
*A43B 7/38* (2006.01)

(52) U.S. Cl.
CPC ..... *A43B 7/38* (2013.01)

(58) Field of Classification Search
CPC ..... A43B 7/1405; A43B 7/1465; A43B 7/147; A43B 7/148; A43B 7/149
USPC ..... 36/43, 50.1
See application file for complete search history.

(56) References Cited

U.S. PATENT DOCUMENTS 1,741,419 A * 12/1929 Jones ..... A43B 7/14 36/145
2,090,675 A * 8/1937 Hadaway ..... A43B 3/126 12/142 S
4,275,512 A * 6/1981 Zeligman ..... A43B 3/124 12/142 S
4,430,810 A * 2/1984 Bente ..... A43B 13/14 36/136
4,450,633 A * 5/1984 Connelly ..... A43B 1/0054 36/101
4,458,431 A * 7/1984 Sinclair ..... A43B 11/00 36/111
4,773,170 A * 9/1988 Moore ..... A43B 21/32 36/11.5
4,860,464 A * 8/1989 Misevich ..... A43B 7/1495 36/114
5,070,868 A * 12/1991 Hepburn ..... A61F 5/0127 602/27
5,176,624 A * 1/1993 Kuehnreich ..... A43B 3/26 602/65

(Continued)

*Primary Examiner* — Jila M Mohandesi

(74) *Attorney, Agent, or Firm* — The Webb Law Firm

(57) ABSTRACT

Disclosed is a shoe-lifting device to be worn on a foot or footwear of a person. The shoe-lifting device includes a base platform having at least two indentations on an upper surface of the base platform. The base platform is configured to support the person and make contact with the ground. The shoe-lifting device also includes at least two straps configured to be connected to the base platform and to secure the shoe-lifting device to the foot or the footwear. The shoe-lifting device further includes at least one height-increasing insert having at least two protrusions. The at least two protrusions are positioned corresponding to the at least two indentations and are configured to be coupled with the at least two indentations. The insert is configured to be positioned in and/or on the base platform and to contact the bottom of the foot or the footwear.

10 Claims, 5 Drawing Sheets

(56) References Cited

U.S. PATENT DOCUMENTS 5,894,687 A * 4/1999 Lin ..... A43B 7/146 36/141
5,896,681 A * 4/1999 Lin ..... A43B 7/146 36/153
5,896,682 A * 4/1999 Lin ..... A43B 13/189 36/29
5,918,338 A * 7/1999 Wong ..... A43B 5/049 12/146 S
5,992,055 A * 11/1999 Connor ..... A43B 1/06 36/11.5
6,102,412 A * 8/2000 Staffaroni ..... A43B 5/16 280/11.225
6,105,280 A * 8/2000 Marcolin ..... A43B 3/0047 36/117.1
6,247,250 B1 * 6/2001 Hauser ..... A43B 7/142 36/154
6,282,818 B1 * 9/2001 Lu ..... A43B 3/24 36/100
6,453,578 B1 * 9/2002 Yung ..... A43B 7/142 36/166
6,637,130 B2 * 10/2003 Urie ..... A43B 3/126 36/11.5
6,694,641 B1 * 2/2004 Gill ..... A43B 3/122 36/11.5
7,614,163 B2 * 11/2009 Fujii ..... A43B 7/08 36/28
8,819,961 B1 * 9/2014 Ellis ..... A43B 7/1415 36/140
11,224,263 B2 * 1/2022 Darby ..... A43B 19/00
2003/0200675 A1 * 10/2003 Gross ..... A43B 13/20 36/15
2004/0098882 A1 * 5/2004 Tuan ..... A43B 17/03 36/29
2004/0118019 A1 * 6/2004 Ito ..... A43B 1/0027 36/50.1
2007/0124959 A1 * 6/2007 Meffan ..... A43B 7/142 36/28
2008/0214975 A1 * 9/2008 Mosier ..... A61F 5/0195 602/29
2008/0216357 A1 * 9/2008 Fogg ..... A43B 3/128 36/25 R
2008/0244928 A1 * 10/2008 Romboli ..... A43C 11/1493 36/50.1
2008/0263900 A1 * 10/2008 Determe ..... A43B 13/12 36/107
2010/0100018 A1 * 4/2010 Fout ..... A61F 5/0195 602/23
2010/0275462 A1 * 11/2010 Pucci ..... A43B 3/122 36/102
2012/0030966 A1 * 2/2012 Huynh ..... A43B 3/108 36/11.5
2013/0067766 A1 * 3/2013 Chou ..... A43B 17/08 36/43
2013/0091729 A1 * 4/2013 Lagneau ..... A43B 9/06 36/29
2013/0255105 A1 * 10/2013 Bishop ..... A43B 3/126 36/88
2014/0259752 A1 * 9/2014 Feldman ..... A43B 1/0081 36/43
2014/0283412 A1 * 9/2014 Elder ..... A43B 13/127 36/102
2014/0296762 A1 * 10/2014 Hecker ..... A61F 5/0585 602/28
2015/0101213 A1 * 4/2015 Brass ..... A43B 3/105 36/102
2017/0127759 A1 * 5/2017 Diemer ..... A43B 17/18

* cited by examiner

SHOE-LIFTING DEVICE

CROSS REFERENCE TO RELATED APPLICATION

This application claims the benefit of U.S. Provisional Application No. 62/365,015, filed Jul. 21, 2016, which is incorporated herein by reference.

BACKGROUND OF THE INVENTION

Field of the Invention

This invention relates generally to a shoe accessory affixed to the sole of an existing shoe or a person's foot. Particularly, it relates to a shoe-lifting device, also called a foot-lifting device, that is attached to the bottom of a shoe with adjustable straps for the purpose of adding additional height to a shoe, adding a layer of padding for enhanced comfort under a shoe, or to destabilize the shoe for the purpose of enhanced cardiovascular usage and athletic training. This shoe-lifting device may be employed in combination with a medical boot to form a lower extremity healing system.

Description of the Prior Art

When a person injures his or her lower extremity, it is common to wear a medical boot around the injured limb. The medical boot raises the injured extremity so that it is no longer level with the uninjured foot. The resulting unevenness can cause pain and discomfort or even secondary injury. Additionally, some people naturally have uneven lengths of lower extremities or develop uneven lower extremities as a result of medical intervention, for example, hip-replacement surgery. Previously, when a person suffered from uneven lower extremities, he or she either lived with the associated discomfort or wore a foot-lifting product to level the body.

In the past, numerous foot-lifting products have been devised, such as the height-increasing shoe insole or the under-shoe outsole attached by rubber webbing. Many of these products do not adequately or safely even the body. Insoles do not provide an adequate amount of additional height to even the body. The previously existing outsole accessory does not securely attach to a shoe, lacks the proper amount of lift to even the body, and includes an optional insert that may fall out of the outsole accessory during normal use.

Past foot-lifting devices have been employed alone, as individual units. When a person injures his lower extremity, a doctor often must prescribe a medical boot and shoe-lifting device separately. This is inconvenient for both the health care provider and the patient who must find each device separately.

Accordingly, there exists a need for a simple, convenient, and secure foot-lifting device that acts as an outsole and attaches to a shoe or foot. Additionally, a need exists for a multi-layer shoe-lifting device that is attached to the bottom of a shoe with one or more straps to be fastened to a foot. Finally, a need exists for a lower extremity healing system that provides both a foot-lifting device and a medical boot as a pair.

SUMMARY OF THE INVENTION

Generally, and preferably, provided is a shoe-lifting device to be worn on a foot or footwear of a person.

Preferably, the shoe-lifting device includes a base platform having at least two indentations. Preferably, the shoe-lifting device includes at least two straps to secure the shoe-lifting device to the foot or the footwear of the person. Preferably, the shoe-lifting device includes at least one height-increasing insert having at least two protrusions to be coupled with the at least two indentations of the base platform.

According to one preferred and non-limiting embodiment or aspect, provided is a shoe-lifting device to be worn on a foot or footwear of a person. The shoe-lifting device includes a base platform including at least two indentations on an upper surface of the base platform. The base platform is configured to support the person and make contact with the ground. The shoe-lifting device also includes at least two straps configured to be connected to the base platform and to secure the shoe-lifting device to the foot or the footwear of the person. The shoe-lifting device further includes at least one height-increasing insert including at least two protrusions. The at least two protrusions are positioned corresponding to the at least two indentations of the base platform and are configured to be coupled with the at least two indentations of the base platform. The insert is configured to be positioned in and/or on the base platform and to contact the bottom of the foot or the footwear of the person.

In further preferred and non-limiting embodiments or aspects, the at least two straps may include a front strap and a back strap. The front strap may be configured to contact and secure above the foot or the footwear of the person. The back strap may be configured to contact and secure behind the foot or the footwear of the person. The at least two straps may further include a fastening means to affix together each pair of ends of the at least two straps, such that when affixed the at least two straps contact and secure the foot or the footwear of the person. The fastening means may include at least one of the following: hook-and-loop fasteners, buckles, clasps, or any combination thereof.

In further preferred and non-limiting embodiments or aspects, the shoe-lifting device may include at least two openings on each side of the base platform to provide for a connection of the at least two straps to the base platform. The shoe-lifting device may also include at least two strap channels in the base platform, each strap of the at least two straps further configured to be positioned through at least one first opening on a first side of the base platform, through a strap channel in the base platform, and through at least one second opening on an opposite side of the base platform. The base platform and/or the height-increasing insert may be manufactured from ethylene-vinyl acetate foam. The at least two protrusions and the at least two indentations may be circular in shape. The at least two indentations may include a first indentation positioned toward a front of the base platform and a second indentation positioned toward a back of the base platform. The at least two straps may be adjustable to be custom-fitted to the foot or the footwear of the person.

In further preferred and non-limiting embodiments or aspects, provided is a lower extremity healing system including the shoe-lifting device described above to be worn on a first leg of the person and a medical boot to be attached to an opposite leg of the person.

Other preferred and non-limiting embodiments or aspects of the present invention will be set forth in the following numbered clauses:

Clause 1: A shoe-lifting device to be worn on a foot or footwear of a person, the shoe-lifting device comprising: a base platform comprising at least two indentations on an upper surface of the base platform, the base platform configured to support the person and make contact with the ground; at least two straps configured to be connected to the base platform and to secure the shoe-lifting device to the foot or the footwear of the person; at least one height-increasing insert comprising at least two protrusions, the at least two protrusions positioned corresponding to the at least two indentations of the base platform and configured to be coupled with the at least two indentations of the base platform, the insert configured to be positioned in and/or on the base platform and to contact the bottom of the foot or the footwear of the person.

Clause 2: The shoe-lifting device of clause 1, wherein the at least two straps comprise a front strap and a back strap, the front strap configured to contact and secure above the foot or the footwear of the person, and the back strap configured to contact and secure behind the foot or the footwear of the person.

Clause 3: The shoe-lifting device of clause 1 or 2, wherein the at least two straps further comprise a fastening means to affix together each pair of ends of the at least two straps, such that when affixed the at least two straps contact and secure the foot or the footwear of the person.

Clause 4: The shoe-lifting device of any of clauses 1-3, wherein the fastening means comprises at least one of the following: hook-and-loop fasteners, buckles, clasps, or any combination thereof.

Clause 5: The shoe-lifting device of any of clauses 1-4, wherein the shoe-lifting device further comprises at least two openings on each side of the base platform to provide for a connection of the at least two straps to the base platform.

Clause 6: The shoe-lifting device of any of clauses 1-5, wherein the shoe-lifting device further comprises at least two strap channels in the base platform, each strap of the at least two straps further configured to be positioned through at least one first opening on a first side of the base platform, through a strap channel in the base platform, and through at least one second opening on an opposite side of the base platform.

Clause 7: The shoe-lifting device of any of clauses 1-6, wherein the base platform and/or the height-increasing insert are manufactured from ethylene-vinyl acetate foam.

Clause 8: The shoe-lifting device of any of clauses 1-7, wherein the at least two protrusions and the at least two indentations are circular in shape.

Clause 9: The shoe-lifting device of any of clauses 1-8, wherein the at least two indentations comprises a first indentation positioned toward a front of the base platform and a second indentation positioned toward a back of the base platform.

Clause 10: The shoe-lifting device of any of clauses 1-9, wherein the at least two straps are adjustable to be custom-fitted to the foot or the footwear of the person.

Clause 11: A lower extremity healing system comprising the shoe-lifting device of any of clauses 1-10 to be worn on a first leg of the person and a medical boot to be attached to an opposite leg of the person.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a," "an," and "the" include plural referents unless the context clearly dictates otherwise.

DETAILED DESCRIPTION OF THE DRAWINGS

Figure 1:
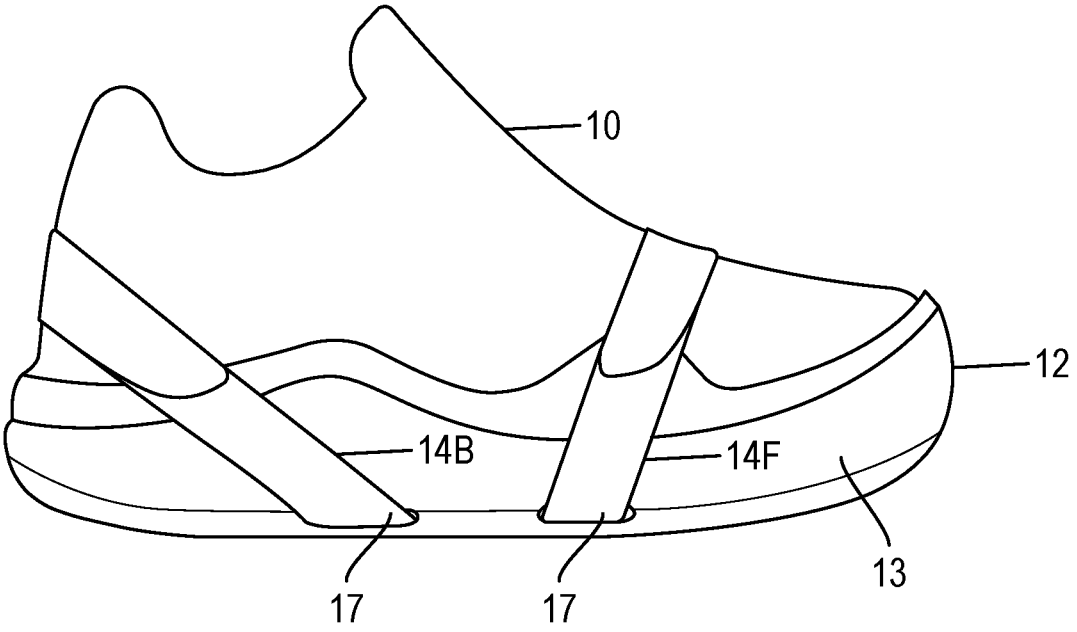
FIG. 1 is a side view illustrating a shoe in a shoe-lifting device according to preferred and non-limiting embodiments or aspects of the invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and process illustrated in the attached drawings, and described in the following specification, are simply exemplary embodiments of the invention. Hence, specific dimensions and other physical characteristics related to the embodiments disclosed herein are not to be considered as limiting. Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

With specific reference to FIG. 1, and in preferred and non-limiting embodiments or aspects of the invention, provided is a shoe-lifting device 12 (also called a foot-lifting device). The shoe-lifting device 12 can be attached to a person's foot directly or be attached to the person's sock or footwear 10 (e.g., shoe, boot, sandal, etc.). The shoe-lifting device 12 may be employed as an individual unit or in combination with a medical boot 21, as shown in FIG. 5. The shoe-lifting device 12 increases the effective length of the person's lower extremity, primarily to even the person's stance and/or gait, e.g., when the person is wearing a medical boot/device on the other leg, when the person is physically affected by uneven leg-lengths or favoring of a leg, and/or the like. The shoe-lifting device 12, particularly its base platform 13, is preferably made of a sturdy and flexible material, such as molded ethylene-vinyl acetate (EVA) foam, but other like materials are sufficient. The shoe-lifting device 12 has a minimum thickness/height determined by a base platform 13, but its thickness/height may be adjusted by the addition of by one or more height-increasing inserts 16, not shown in FIG. 1 but depicted in FIGS. 2 and 4. The person's foot or footwear 10 may be secured to the shoe-lifting device 12 by one or more straps 14F, 14B, which are preferably made of a fabric or elastic material, e.g., nylon, nubuck, neoprene, and/or the like. The straps may be secured by a fastening means, such as hook-and-loop fasteners (e.g., Velcro), buckles, clasps, or any other suitable means, and are configured to be adjustable to accommodate the person's foot or footwear. The arrangement depicted includes a front strap 14F positioned above to contact and secure the top of the person's footwear 10, and a back strap 14B positioned behind to contact and secure the person's heel. It will be appreciated that the one or more straps 14F, 14B may be positioned in many other configurations that are sufficient for securing the person's foot or footwear 10 to the device 12. As shown, the straps 14F, 14B are threaded through openings 17 in the sides of the shoe-lifting device 12 and are secured around the person's footwear 10. It will be appreciated that many configurations are possible.

Figure 2:
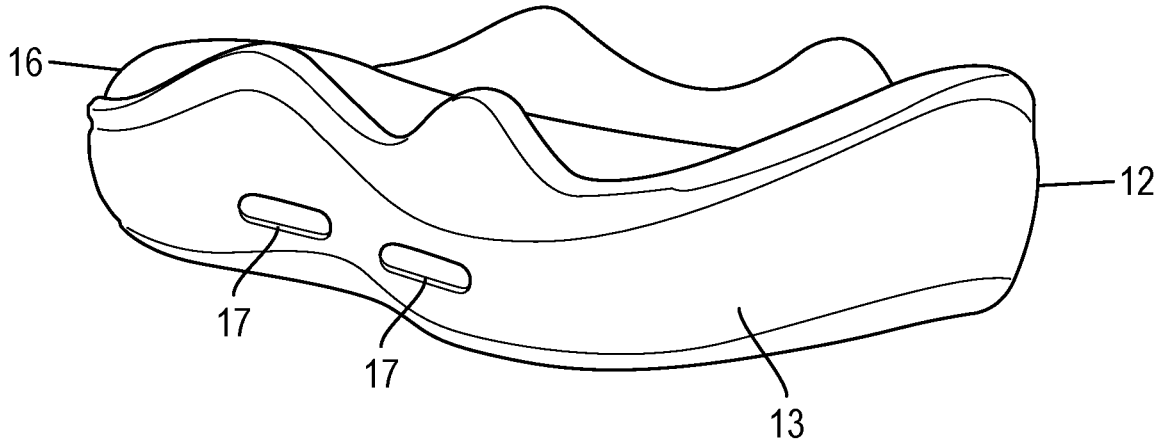
FIG. 2 is a side and behind view illustrating a shoe-lifting device including a height-increasing insert according to preferred and non-limiting embodiments or aspects of the invention.

With specific reference to FIG. 2, and in preferred and non-limiting embodiments or aspects of the invention, provided is a shoe-lifting device 12 (also called a foot-lifting device). The shoe-lifting device 12 has a minimum thickness/height determined by a base platform 13, but its thickness/height may adjusted by the addition of by one or more height-increasing inserts 16 (see FIG. 4 for example insert 16). The height-increasing insert 16 may be made out of any sturdy and flexible material, such as molded EVA foam, but other like materials are sufficient. The height-increasing insert 16 may be made out of the same or different material as the base platform 13. The height-increasing insert 16 is placed in/on the base platform 13 to add a second level of height that is useful to more precisely even the stance/gait of the person. The shoe-lifting device 12 also includes one or more openings 17 on the sides of the device 12 to allow one or more straps (not shown) to be connected to the device 12 and around the person's foot.

Figure 3:
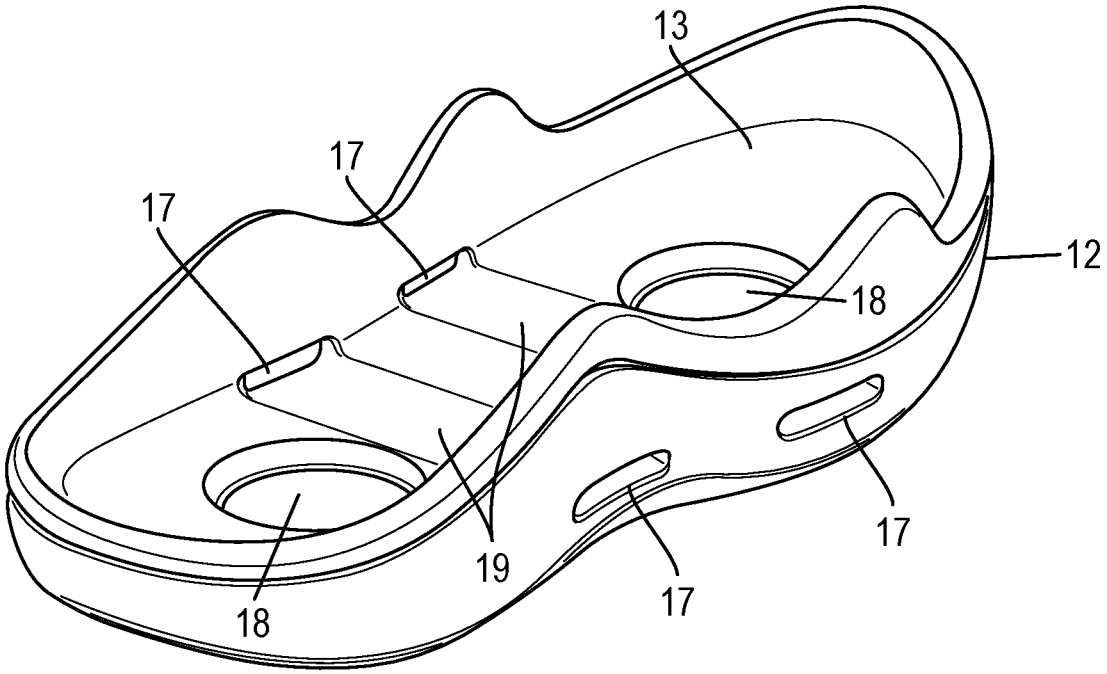
FIG. 3 is a top and front-side view illustrating a shoe-lifting device without a height-increasing insert according to preferred and non-limiting embodiments or aspects of the invention.

With specific reference to FIG. 3, and in preferred and non-limiting embodiments or aspects of the invention, provided is a shoe-lifting device 12 (also called a foot-lifting device). The shoe-lifting device includes at least a base platform 13, which provides a minimum thickness/height for the person's lower extremity. The shoe-lifting device 12 includes one or more openings 17 to allow one or more straps (not shown) to be connected to the device 12 and the person's footwear/foot. As depicted, the shoe-lifting device 12 further includes strap channels 19 in the base platform 13 to allow the straps to run comfortably under the person's foot or the optional height-increasing inserts. Alternatively, the straps may be configured to connect to the sides of the shoe-lifting device 12 without running through the device 12. The shoe-lifting device 12 further includes indentations 18 in the base platform 13, which act as connection points for the protrusions 20 of an optional height-increasing insert 16 (not shown, see FIG. 4 for example insert 16). The indentations 18 of the base platform 13 are coupled with the protrusions 20 of the height-increasing insert 16 to prevent slippage of the insert 16. It will be appreciated that other configurations are possible.

Figure 4:
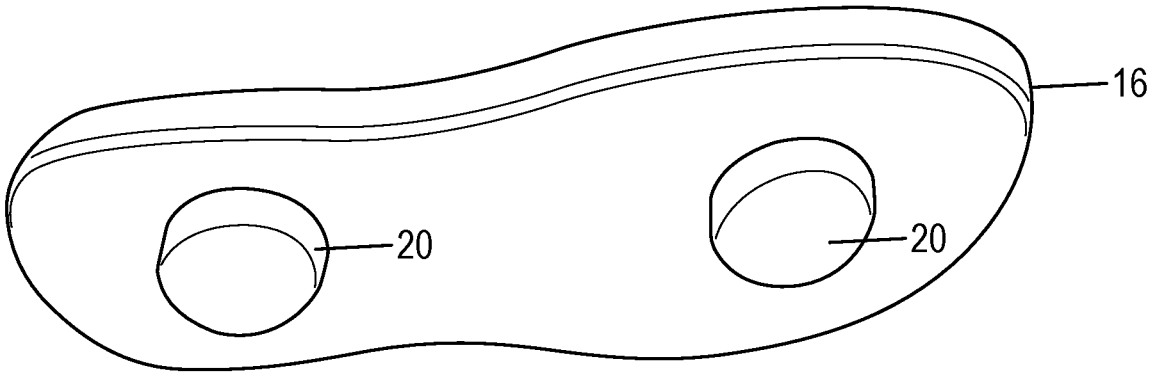
FIG. 4 is a bottom-side view illustrating a height-increasing insert for use with a shoe-lifting device according to preferred and non-limiting embodiments or aspects of the invention.
Figure 5:
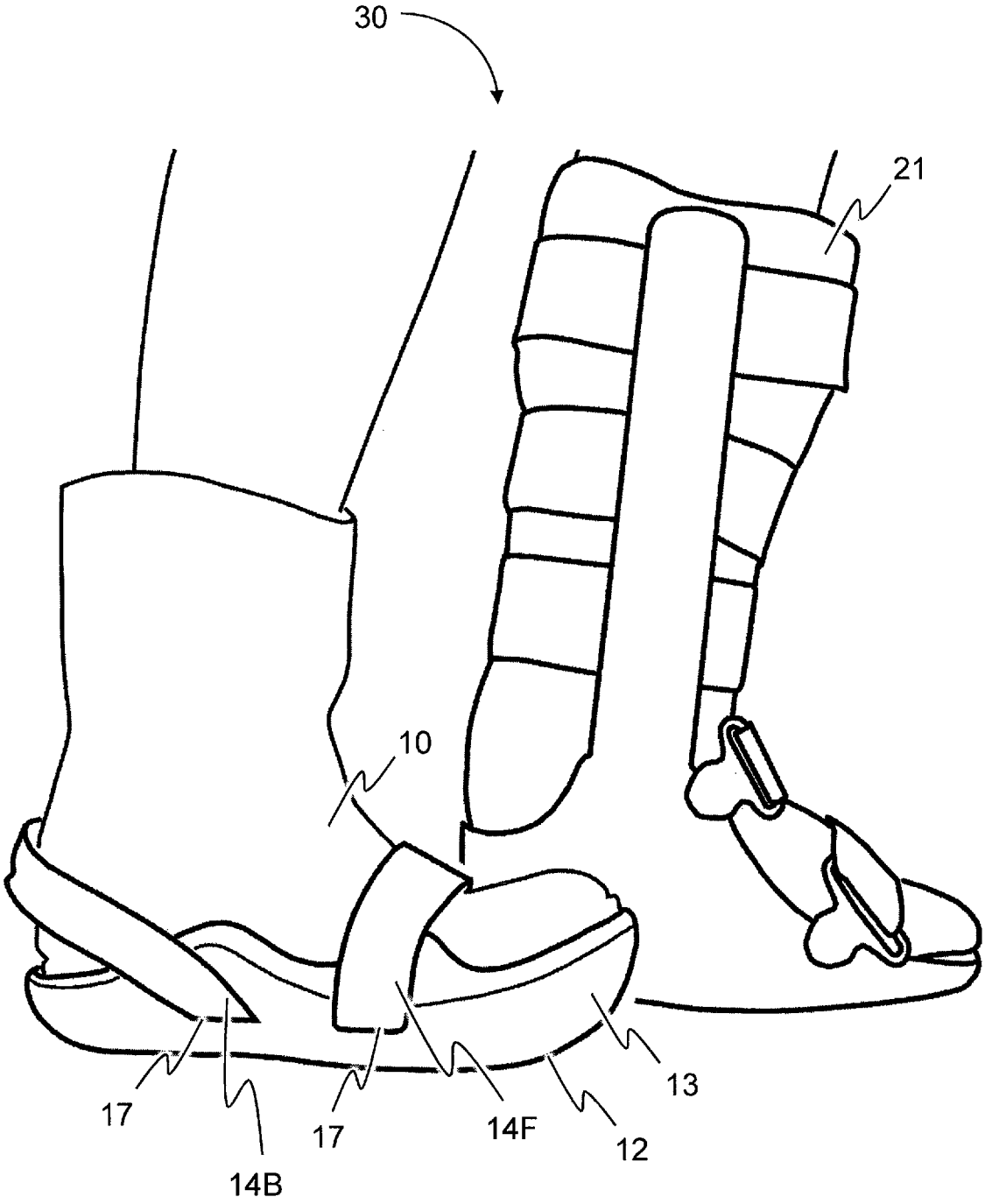
FIG. 5 is a side view illustrating a lower extremity healing system, which combines both a shoe-lifting device and a medical boot according to preferred and non-limiting embodiments or aspects of the invention.

With further reference to FIG. 3 and specific reference to FIG. 4, and in preferred and non-limiting embodiments or aspects of the invention, provided is a height-increasing insert 16 for use with a shoe-lifting device 12, particularly for placement in/on a base platform 13. The height-increasing insert 16 may be molded with at least two protrusions 20 that fit into at least two matching indentations 18 in the base platform 13, to ensure that the insert 16 does not slip or shift during regular usage. The depicted protrusions 20 and indentations 18 are circular, to promote ease of coupling and alignment due to the regular shape, but it will be appreciated that other shapes will suffice. It will also be appreciated that more than two protrusions 20 and indentations 18 may be used, with corresponding patterns and positioning to allow for coupling of the insert 16 and the base platform 13. The shoe-lifting device 12 may be worn alone without the height-increasing insert 16, but if additional thickness/height is needed, one or more inserts 16 may be placed in the shoe. Alternatively, inserts 16 may be manufactured with varying thicknesses and chosen based on the thickness/height required by the person. It will also be appreciated that the protrusions 20 may be positioned on the platform 13 and the indentations may be positioned on the insert 16. Other configurations are possible.

With specific reference to FIG. 5, and in preferred and non-limiting embodiments or aspects of the invention, provided is a lower extremity healing system 30 that includes a shoe-lifting device 12 in tandem with a medical boot 21. The shoe-lifting device 12 is attached to the person's footwear 10 (or foot) and includes at least a base platform 13. The shoe-lifting device 12 may include one or more optional height-increasing inserts 16 (not shown) in/on the base platform 13. The shoe-lifting device 12 is attached to the person's footwear 10 by one or more straps 14F, 14B. As shown, a front strap 14F is positioned on top of the person's foot and a back strap 14B is positioned behind the person's heel. The straps 14F, 14B are connected to the shoe-lifting device 12 via openings 17 in the sides of the device 12. By wearing the shoe-lifting device 12 (with optional inserts 16), the person's stance/gait may be made even with respect to the medical boot 21 on the person's other leg. In this manner, the injured leg having the medical boot 21 may be stabilized and protected, but without destabilizing the person's body by creating unequal lower extremity lengths. It will be appreciated that the shoe-lifting device 12 may be positioned on either or both feet, may be used in conjunction with other devices, and may employ other configurations.

Further to the foregoing figures, the invention acts as a displacement device to redistribute the weight of the person. It adds support and takes weight off the sole of the foot and distributes it to the perimeter. Without the shoe-lifting device 12, a patient using a medical boot 21 may have unevenly distributed weight, favoring the lower-positioned leg without the medical boot 21. Furthermore, the shoe-lifting device 12, with or without an insert 16, may be configured at a thickness to intentionally displace the user's weight to favor one leg over another. In some embodiments, the shoe-lifting device 12 may be employed as a yoga shoe or an apres ski shoe. As previously described, the shoe-lifting device 12 may be worn directly on the foot or attached to a shoe 10, and the shoe-lifting device 12 may be modeled for, or malleable to adjust to, various shoe types. A device 12 may also be worn on both feet and independently adjusted to the same or different heights. It will be appreciated that other configurations are possible.

The foregoing exemplary descriptions and the illustrative preferred embodiments of the present invention have been explained in the drawings and described in detail, with varying modifications and alternative embodiments being taught. While the invention has been shown, described and illustrated, it should be understood by those skilled in the art that equivalent changes in the form and detail may be therein without departing from the true spirit and scope of the invention, and that the scope of the present invention is to be limited only to the claims except as precluded by the prior art. Moreover, the invention as disclosed herein, may be suitably practiced in the absence of the specific elements that are disclosed herein.

What is claimed is:

1. A device configured to be worn on an article of footwear, the device comprising:

a base platform comprising a first indentation and a second indentation, said indentations each having a width equal to approximately at least one-third a width of the base platform, the first indentation located in a front half of the base platform and the second indentation located in a back half of the base platform;

the base platform configured to make contact with the ground, portions of the base below a heel area and a toe area of the footwear being rounded upward;

at least two straps configured to be connected to the base platform and to secure the device to said footwear, one strap being securable across a top of said footwear, the other strap securable above a heel of said footwear;

at least two strap channels formed in the base platform, traversing the width of the base platform and receiving the straps; and at least one height-increasing, selectively removable insert comprising at least two protrusions, the at least two protrusions sized, shaped, and positioned so as to be received in the first and second indentations of the base platform, the insert configured to be positioned on the base platform without slippage between the base platform and insert, said insert configured to contact the bottom of the footwear, wherein said device is employed to lift said footwear and increase an effective length of the wearer's leg.

2. The device of claim 1, wherein the straps are securable by at least one of the following: hook-and-loop fasteners, buckles, clasps, or any combination thereof.

3. The device of claim 1, wherein the device further comprises at least two openings on each side of the base platform, said openings in communication with said strap channels to provide for a connection of the at least two straps to the base platform.

4. The device of claim 1, wherein the base platform is manufactured from ethylene-vinyl acetate foam.

5. The device of claim 1, wherein the at least two protrusions and the at least two indentations are circular in shape.

6. The device of claim 1, wherein the at least two straps are adjustable to be custom-fitted to the footwear.

7. Footwear, comprising:

the device of claim 1 securable to a shoe; and a medical boot configured to be worn opposite said shoe.

8. The device of claim 1, wherein the height-increasing insert is manufactured from ethylene-vinyl acetate foam.

9. The device of claim 1, wherein the device is employed opposite a medical boot.

10. The device of claim 1, further comprising a lip extending from a top portion of the base platform, said lip extending above a top surface of said insert.

* * * * *